United States Patent [19]

Sagiv

[11] Patent Number: 4,883,018

[45] Date of Patent: Nov. 28, 1989

[54] LIQUID INK DEVELOPMENT SYSTEM

[75] Inventor: Oded Sagiv, Rehovot, Israel

[73] Assignee: Xerox Corporation, Stamford, Conn.

[21] Appl. No.: 263,941

[22] Filed: Oct. 28, 1988

[51] Int. Cl.[4] ..... G03G 13/10

[52] U.S. Cl. ..... 118/660; 355/256

[58] Field of Search ..... 118/660, 662, 645, 659; 355/256; 430/117–119

[56] References Cited

U.S. PATENT DOCUMENTS

| | | | |
|---|---|---|---|
| 3,669,073 | 6/1972 | Sauit et al. | 118/637 |
| 3,791,345 | 2/1974 | McCutcheon | 118/637 |
| 3,859,960 | 1/1975 | Lloyd | 118/637 |
| 4,160,593 | 7/1979 | Rosenburgh | 355/256 X |
| 4,173,945 | 11/1979 | McFarland | 118/660 |
| 4,236,483 | 12/1980 | Davis et al. | 118/647 |
| 4,383,019 | 5/1983 | Simm | 430/45 |
| 4,521,101 | 6/1985 | Suzuki et al. | 355/256 |
| 4,576,467 | 3/1986 | Yamasaki et al. | 355/256 |
| 4,586,809 | 5/1986 | Miyauchi et al. | 118/662 X |

*Primary Examiner*—R. L. Moses

*Attorney, Agent, or Firm*—H. Fleischer; J. E. Beck; R. Zibelli

[57] ABSTRACT

An apparatus which develops a latent image recorded on a generally planar photoconductive member moving in a direction at least partially inclined with respect to the gravitational force exerted thereon. The latent image is developed with a liquid developer material in an extended development zone substantially parallel to the photoconductive member. The liquid developer material is pumped partially upwardly from the lowermost region of the development zone toward the uppermost region thereof. This forms a pressure barrier preventing the escape of liquid developer material from the lowermost region of the development zone. A sealing roller prevents the escape of liquid developer material from the uppermost region of the development zone.

33 Claims, 4 Drawing Sheets

LIQUID INK DEVELOPMENT SYSTEM

This invention relates generally to an electrophotographic printing machine, and more particularly concerns development of a latent image with a liquid developer material.

Generally, the process of electrophotographic printing includes charging a photoconductive member to a substantially uniform potential to sensitize the surface thereof. The charged portion of the photoconductive member is exposed to a light image of an original document being reproduced. This records an electrostatic latent image on the photoconductive member corresponding to the informational areas contained within the original document. After the electrostatic latent image is recorded on the photoconductive member, the latent image is developed by bringing a liquid developer material into contact therewith. The liquid developer material comprises a liquid carrier having pigmented particles, i.e. toner particles, dispersed therein. The toner particles are deposited, in image configuration, on the photoconductive member. Thereafter, the developed image is transferred to the copy sheet. Invariably, some of the liquid carrier is transferred along with the toner particles to the copy sheet. After transfer, heat is applied to the copy sheet to permanently fuse the toner particles to the copy sheet and vaporize the residual liquid carrier adhering thereto. Frequently, the photoconductive member is a belt moving on an incline against gravity. Under these circumstances, the liquid developer material tends to escape from the development system wetting the other components of the printing machine. This degrades machine performance and copy quality.

Numerous techniques have been developed for applying liquid developer material on the latent image. However, not only must the latent image be developed with the liquid developer material, but the developer housing must be sealed with respect to a moving photoconductive belt. The seal must be capable of preventing developer material from escaping while not damaging the photoconductive belt or disturbing the liquid image formed thereon. Thus, the development system must perform two simultaneous functions, i.e. develop the latent image, and seal the development system to prevent the escape of liquid developer material therefrom. Hereinbefore, various techniques have been devised for developing a latent image with liquid developer material while sealing the development system. The following disclosures appear to be relevant:

U.S. Pat. No. 3,669,073; Patentee: Savit et al. Issued: June 13, 1972.

U.S. Pat. No. 3,791,345 Patentee: McCutcheon Issued: Feb. 12, 1974

U.S. Pat. No. 3,859,960 Patentee: Lloyd Issued: Jan. 14, 1975

U.S. Pat. No. 173,945 Patentee: McFarland Issued: Nov. 13, 1979

U.S. Pat. No. 4,236,483 Patentee: Davis et al. Issued: Dec. 2, 1980

U.S. Pat. No. 4,383,019 Patentee: Simm Issued: May 10, 1983

The relevant portions of the foregoing disclosures may be briefly summarized as follows:

U.S. Pat. No. 3,669,073 discloses an electrostatic development system comprising a roll and a guide plate for guiding a sheet onto an upwardly moving belt. The belt is driven by two cylindrical rolls and drive two exit rolls. A flow control system using a pump and spray header distributes a liquid developer onto the surface of the belt.

U.S. Pat. No. 3,791,345 describes a liquid toner applicator having a plurality of rollers for guiding a sheet through a gap formed by a pair of surfaces. Liquid developer is pumped upwardly towards an inlet gap.

U.S. Pat. No. 3,859,960 discloses a printing machine having an electrostatic web developing apparatus. A fountain of developing toner fluid contacts the web of recording material upstream of an upwardly extending wiper blade. The wiper blade removes excess toner fluid from the web of recording material. The developer liquid is pumped into the fountain tray through a flow passage and returned through another flow passage.

U.S. Pat. No. 4,173,945 describes an electrostatic printing machine in which a plurality of rollers guide an upwardly moving web. A toner fountain has trays for catching the toner. The toner is pumped into the trays by a pump and returned through return lines to a reservoir.

U.S. Pat. No. 4,236,483 discloses a metering roll located between a developing station and a transfer station of a copier. The metering roll controls the thickness of the layer of liquid on the surface of the photoconductive drum.

U.S. Pat. No. 4,383,019 describes a process for electrophotographic color image development wherein a developer liquid is pumped upwardly through a feed pipe over a distributor plate and into a development zone. The developer liquid is prevented from leaking out at the boundary wall of a return tank by a nozzle. Pressurized air is introduced through the nozzle in the opposite direction to the direction of liquid flow so that the liquid is returned to the tank through a return pipe.

In accordance with one aspect of the present invention, there is provided an apparatus for developing a latent image recorded on a generally planar member moving in a direction at least partially opposed to the direction of the gravitational force exerted thereon with a liquid developer material. The apparatus includes means, defining an extended development zone substantially parallel to the generally planar member, for developing the latent image recorded on the planar member. The developing means cooperates with the generally planar member to pump the liquid developer material in at least a partially upwardly direction from the lowermost region of the development zone to the uppermost region thereof. This forms a pressure barrier preventing the escape of liquid developer material from the lowermost region of the development zone. Means seal the uppermost region of the development zone to prevent the escape of liquid developer material thereat.

Pursuant to another aspect of the present invention, there is provided an electrophotographic printing machine of the type having an electrostatic latent image recorded on a generally planar photoconductive member moving in a direction at least partially opposed to the direction of the gravitational force extended development zone substantially parallel to the generally planar member, for developing the latent image recorded on the planar member with a liquid developer material. The developing means cooperates with the photoconductive member to pump the liquid developer material in at least a partially upwardly direction from the lowermost region of the development zone to the uppermost region thereof. This forms a pressure barrier preventing the escape of liquid developer material from the lowermost region of the development zone. Means seal the uppermost region of the development zone to prevent the escape of liquid developer material thereat.

Other aspects of the present invention will become apparent as the following description proceeds and upon reference to the drawings, in which.

While the present invention will hereinafter be described in conjunction with various embodiments thereof, it will be understood that it is not intended to limit the invention to these embodiments. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
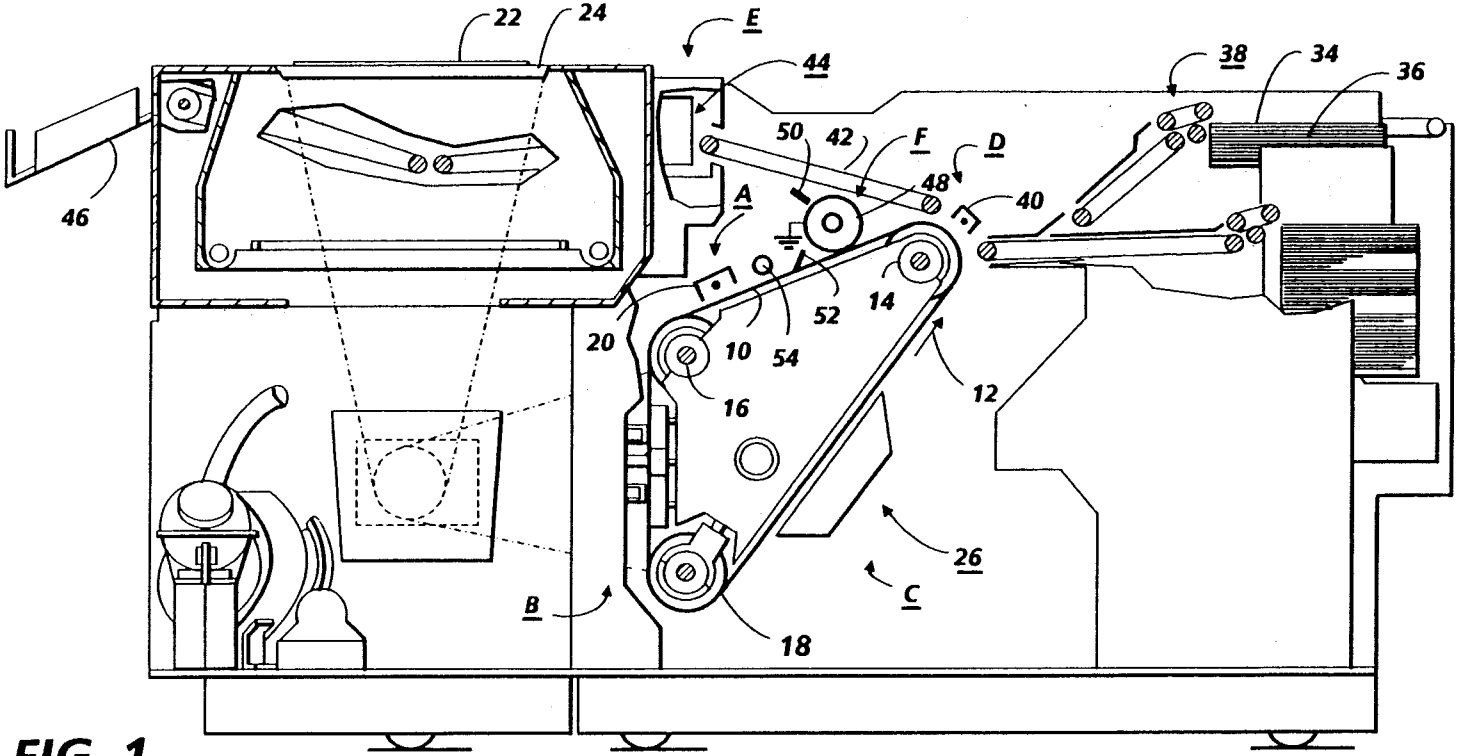
FIG. 1 is a schematic elevational view showing an illustrative electrophotographic printing machine incorporating the features of the present invention therein.

Turning now to FIG. 1, the electrophotographic printing machine employs a belt 10 having a photoconductive surface deposited on a conductive substrate. Preferably, the photoconductive surface is made from a selenium alloy with the conductive substrate being made from an electrically grounded aluminum alloy. Other suitable photoconductive surfaces and conductive substrates may also be employed. Belt 10 moves in the direction of arrow 12 to advance successive portions of the photoconductive surface through the various processing stations disposed about the path of movement thereof. Belt 10 is supported by three rollers 14, 16, and 18 located with parallel axes at approximately the apexes of a triangle. Roller 14 is rotatably driven by a suitable motor associated with a drive (not shown) to move belt 10 in the direction of arrow 12.

Initially, a portion of belt 10 passes through charging station A. At charging station A, a corona generating device, indicated generally by the reference numeral 20,c harges the photoconductive surface of belt 10 to a relatively high, substantially uniform potential.

Next, the charged portion of the photoconductive surface is advanced through exposure station B. At exposure station B, an original document 22 is positioned face down upon a transparent platen 24. Lamps flash light rays onto orginal document 22. The light rays reflected from original document 22 are transmitted through a lens forming a light image thereof. The lens focuses the light image onto the charged portion of the photoconductive surface to selectively dissipate the charge thereon. This records an electrostatic latent image on the photoconductive surface corresponding to the informational areas contained within the original document. Thereafter, belt 10 advances the electrostatic latent image recorded on the photoconductive surface to development station C.

At development station C, a development system, indicated generally by the reference numeral 26, advances a developing liquid comprising insulating carrier liquid and toner particles, adjacent the electrostatic latent image recorded on the photoconductive surface of belt 10. Belt 10 is inclined with respect to the force of gravity at the development station. The charged toner particles, disseminated throughout the carrier liquid, pass by electrophoresis to the electrostatic latent image. The charge of the toner particles is opposite in polarity to the charge on the photoconductive surface. By way of example, if the photoconductive surface is made from a selenium alloy, the photoconductive surface will be positively charged and the toner particles will be negatively charged. Alternatively, if the photoconductive surface is made from a cadmium sulfide material, the photoconductive surface will be negatively charged and the toner particles will be positively charged. Further details concerning the various embodiments of the development system will be discussed hereinafter with reference to FIGS. 2 through 7, inclusive.

After development, belt 10 advances the developed image to transfer station D. At transfer station D, a sheet of support material 34, i.e. a cop sheet, is advanced from stack 36 by a sheet feeder, indicated generally by the reference numeral 38. The sheet of support material advances in synchronism with the movement of the developed image on belt 10 so as to arrive simultaneously therewith at transfer station D. Transfer station D includes a corona generating device 40 which sprays ions onto the backside of the copy sheet. After transfer, the copy sheet continues to move onto conveyor 42 which advances the sheet to fusing station E.

Fusing station E includes a fusing system indicated generally by the reference numeral 44. The fuser assembly includes a radiant fuser which vaporizes the liquid carrier from the copy sheet and permanently fuses the toner particles, in image configuration, thereto. After fusing, the copy sheet is advanced to catch tray 46 for subsequent removal from the printing machine by the operator.

After the copy sheet is separated from the photoconductive surface of belt 10, some residual liquid developer material remains adhering thereto. This residual developer material is removed from the photoconductive surface at cleaning station F. Cleaning station F includes a cleaning roller 48, formed of any appropriate synthetic resin driven in a direction opposite to the direction of movement of the photoconductive surface to scrub the photoconductive surface clean. to assist in this action, developing liquid may be fed through pipe 50 onto the surface of cleaning roller 48. A wiper blade 52 completes the cleaning of the photoconductive surface. Any residual charge left on the photoconductive surface is extinguished by flooding the photoconductive surface with light from lamp 54.

Preferably, the developer material includes a liquid insulating carrier having pigmented particles, i.e. toner particles, dispersed therein. A suitable insulating liquid carrier may be made from an aliphatic hydrocarbon, such as an Isopar, which is a trademark of the Exxon Corporation, having a low boiling point. The toner particles include a pigment, such as carbon black, associated with the polymer. A suitable liquid developer material is described in U.S. Patent No. 4,582,774, issued to Lands in 1986, the relevant portions thereof being incorporated into the present application. However, one skilled in the art will appreciate that the apparatus of the present invention and the various embodiments thereof may be used with any suitable liquid developer material and are not intended to be limited in their use to any specific type of liquid developer material.

It is believed that the foregoing description is sufficient for purposes of the present application to illustrate the general operation of an electrophotographic printing machine incorporating the features of the present invention therein.

Figure 2:
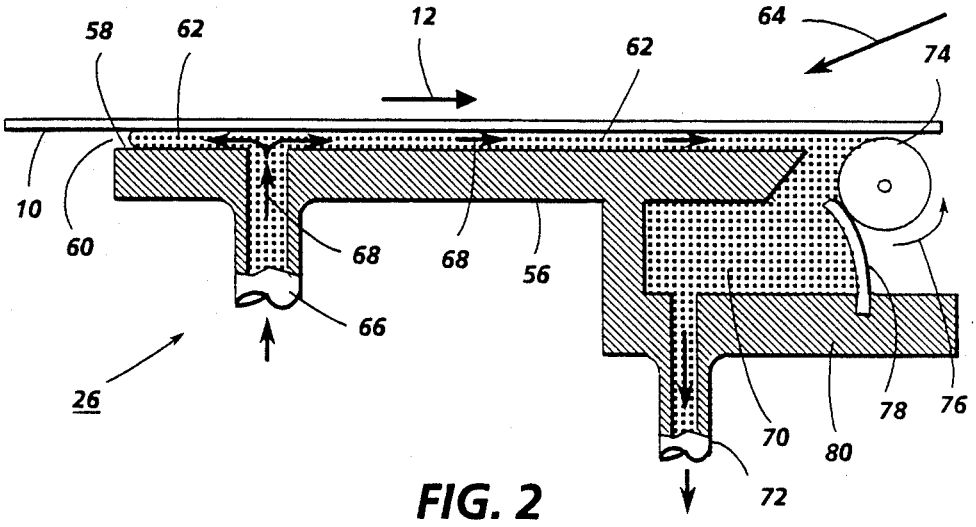
FIG. 2 is a schematic elevational view depicting one embodiment of a development system used in the FIG. 1 printing machine.

Referring now to FIG. 2, there is shown one embodiment of development system 26 in greater detail. As depicted thereat, development system 26 includes a member 56 having a generally planar surface 58 opposed and spaced from belt 10 to define an elongated gap 60 therebetween. Member 58 may be a plate made from a suitable metal material. Gap 60 functions as the development zone with liquid developer material 62 being maintained therein. Belt 10 is inclined with respect to the force of gravity, as indicated by the arrow 64. Thus, a component of the force of gravity is opposed to the direction of movement of belt 10, as indicated by arrow 12. An anti-stick coating, e.g. a polytetrafluorethylene such as Teflon, is coated on surface 58. This prevents the liquid developer material from adhering to surface 58 of plate 56. An entrance port 66 is located in the lower region of the development zone. Liquid developer material is pumped through entrance port 66 into the development zone in the direction of arrows 68. An expansion liquid collecting chamber 70 is located in the upper region of the development zone and receives the unused liquid developer material. An exit port 72 is located in the chamber 70 to remove the extraneous liquid developer material therefrom. A premetering roller 74 is also located in the upper region of the development zone partially in chamber 70. Roller 74 rotates in the direction of arrow 76. The direction of the tangential velocity of roller 74, at the point most closely adjacent to belt 10, is opposed to the movement of belt 10, as indicated by arrow 12. In this way, roller 74 meters the amount of liquid developer material adhering to the photoconductive surface of belt 10 to shear or remove the extraneous liquid developer material therefrom. A sealing blade 78 has one end thereof secured to a wall 80 of chamber 70. The free end of blade 78 presses against sealing roller 74 to remove the liquid developer material therefrom and deposit it in the chamber 70. Side sealing is achieved with sliding seals which contact belt 10. Belt 10 slides over these seals which prevent the escape of liquid developer material from the sides of belt 10. By way of example, roller 74 may be made from a suitable metal material with blade 78 being made from a flexible polyurethane material. A voltage source (not shown) electrically biases plate 56 to a suitable polarity and magnitude so that toner particles in the liquid carrier of liquid developer material 62 are attracted to the electrostatic latent image recorded on belt 10.

In operation, liquid developer material 62 is pumped through entrance port 66 into gap 60. The developer material moves in the direction of arrows 68 in gap 60. As belt 10 moves in the direction of arrow 12, a portion of the liquid developer material 62 in gap 60 moves therewith in a direction opposed to the component of the force of gravity. Thus, the liquid developer material moves, at least partially, uphill. The uphill moving liquid developer material overcomes the pump pressure and gravitational force exerted thereon to prevent any liquid from dripping from the lowermost region of the development zone. A pressure barrier is formed by the liquid moving with belt 10 in the direction of arrow 12. In the development zone, toner particles are attracted to the electrostatic latent image. Roller 74 meters the quantity of liquid developer material adhering to the photoconductive surface of belt 10 and acts as a seal transporting the extraneous liquid developer material into chamber 70. The liquid developer material exits from chamber 70 through exit port 72.

Figure 3:
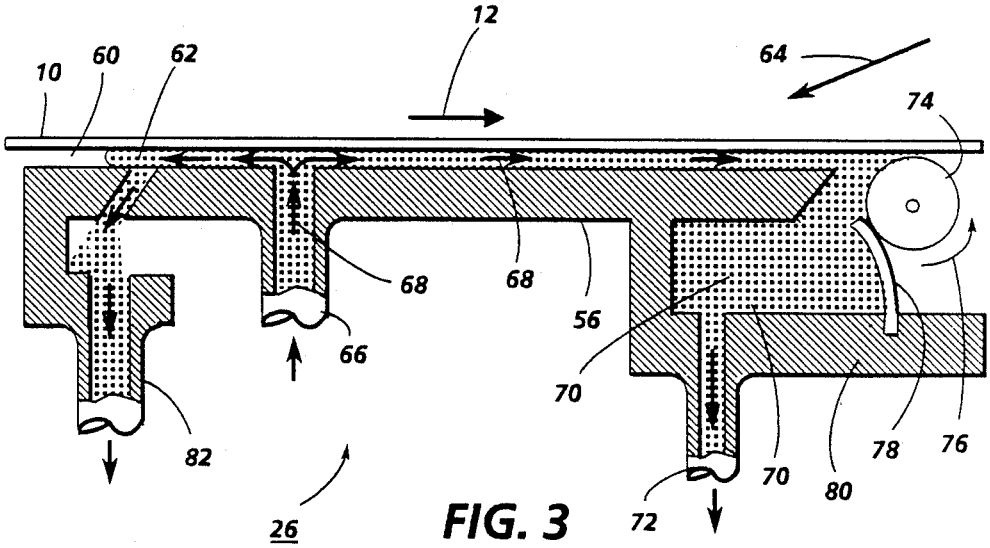
FIG. 3 is a schematic elevational view showing another embodiment of the development system used in the FIG. 1 printing machine.

Turning now to FIG. 3, there is shown another embodiment of development system 26. The embodiment shown in FIG. 3 is substantially identical to the embodiment depicted in FIG. 2. Thus, only the difference between the FIG. 2 embodiment and the FIG. 3 embodiment will be discussed hereinafter. As shown in FIG. 3, an additional exit port 82 is located in the lowermost region of the development zone. Hence, entrance port 66 is located intermediate exit ports 77 and 82. Exit port 82 drains the liquid developer material from the gap 60 in the lower region thereof to enable the drag seal, i.e. the sealing of the liquid developer material in the lowermost region due to the movement of belt 10 inthe direction of arrow 12 and the dragging of the liquid developer material therewith, to function more easily. Exit port 82 relieves the pressure by draining liquid developer material in the lower region.

Figure 4:
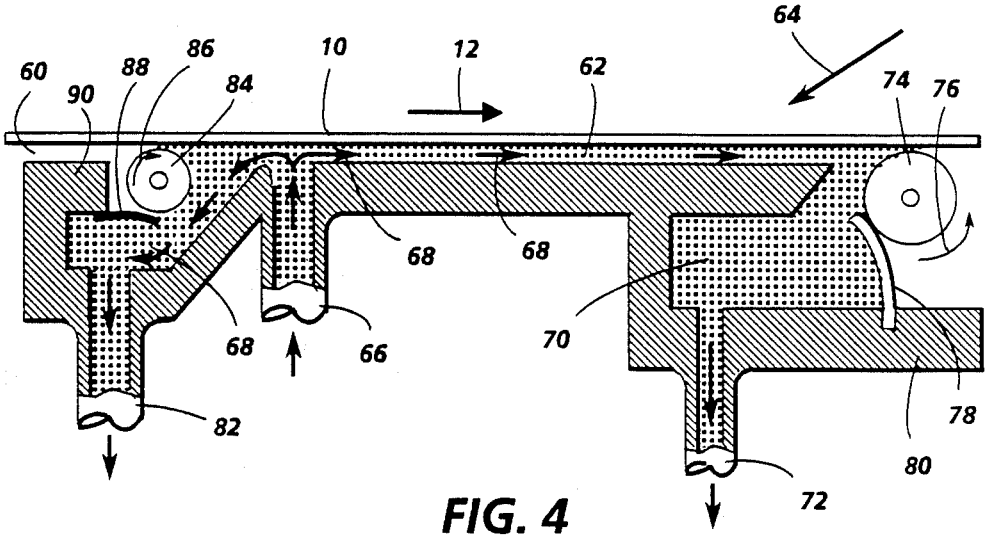
FIG. 4 is a schematic elevatioal view illustrating another embodiment of the development system used in the FIG. 1 printing machine.

Referring to FIG. 4, there is depicted another embodiment of development system 26. The embodiment illustrated in FIG. 4 is substantially identical to the embodiment depicted in FIG. 3. Only the differences between the FIG. 3 embodiment and the FIG. 4 embodiment will be discussed. The FIG. 4 embodiment of development system 26 dds the feature of a sealing roller 84 located in the lowermost region of the development zone. Sealing roller 84 rotates in the direction of arrow 86. The tangential velocity of selaing roller 84 at the point most closely adjacent belt 10 is in the direction movement of belt 10, as indicated by arrow 12. A sealing blade has one end thereof fixed to wall 90 with the free end thereof contacting sealing roller 84 to remove the liquid developer material therefrom so that it exits through exit port 82. Sealing roller 84 is positioed closely adjacent belt 10 in the lowermost region of the development zone to create a moving gap which restricts the escape of liquid developer material from the lowermost region of the development zone. By way of example, sealing roller 84 may be made from a suitable metal material with blade 88 being made from a suitable flexible polyurethane material.

Figure 5:
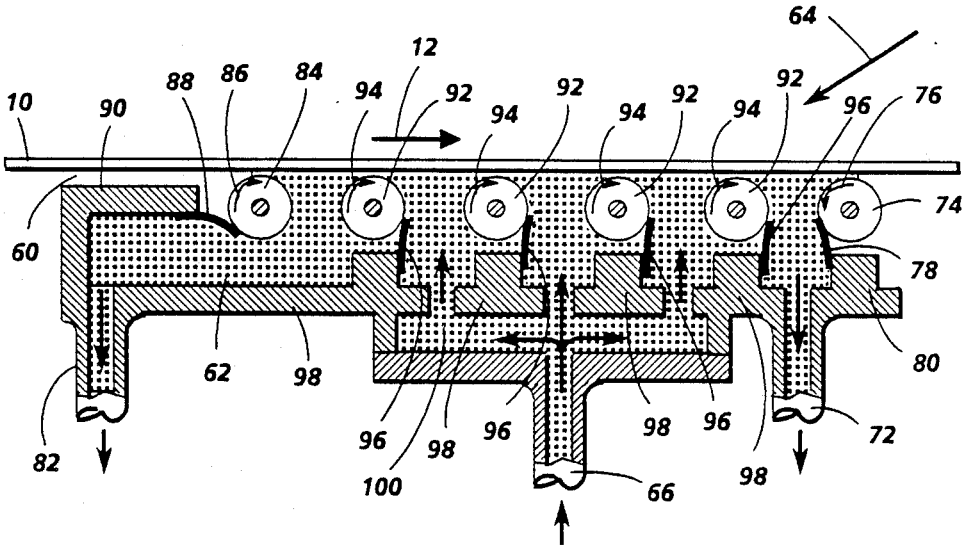
FIG. 5 is a schematic elevational view decpiting another embodiment of the development system used in the FIG. 1 printing machine.

Turning now to FIG. 5, there is illustrated another embodiment of development system 26. The embodiment of development system 26 depicted in FIG. 5 is similar, in some respects to the embodiment thereof depicted in FIG. 4. Once again, only the distinctions between the embodiments of FIGS. 4 and 5 will be discussed. As depicted in FIG. 5, a plurality of developer rollers 92 are positioned closely adjacent belt 10. The developer rollers are spaced from one another. Each developer roller 92 rotates in the direction of arrow 94. The tangential velocity of each developer roller, at the point most closely adjacent belt 10, is in the same direction as that of of belt 10, as indicated by arrow 12. Cleaning blades 96 have one end thereof secured to the wall 98 with the free ends thereof contacting the respective developer roller 92. The developer rollers contain the liquid developer material and advance it into contact with belt 10 to develop the electrostatic latent image recorded on the photoconductive surface thereof. By way of example, developer rollers 92 are made from a suitable metal material with cleaning blades 96 being made from a suitable flexible polyurethane sheet material. The developer rollers may also be electrically biased. Liquid developer material is pumpd into entrance port 66 from a supply thereof. The incoming liquid developer material enters a chamber 100 and exits therefrom through ports adjacent the developer rollers. In this way, the incoming liquid developer material is directed onto each of the developer rollers, which, in turn, advance the liquid developer material into contact with the photoconductive surface of belt 10 to develop the electrostatic latent image recorded thereon.

Figure 6:
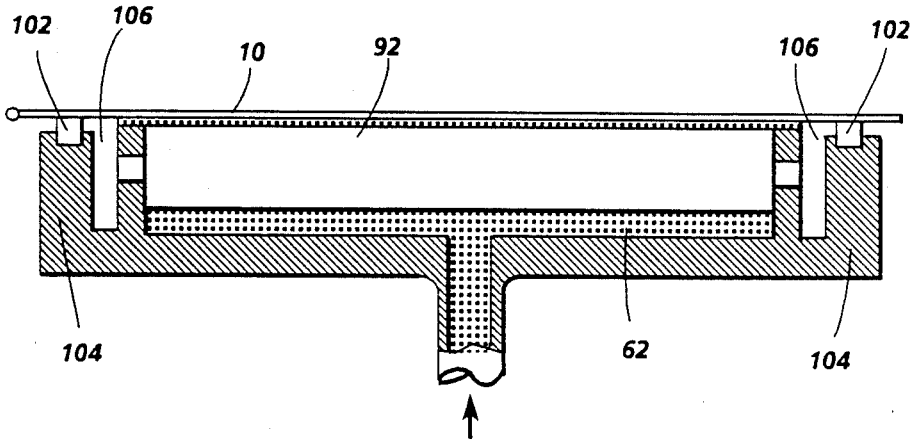
FIG. 6 is a plan view showing a developer roller used in the FIG. 5 development system.

FIG. 6 is a plan view showing details of an illustrative developer roller 92 used in the FIG. 5 development system. As shown thereat, side seals 102 are secured to the walls 104. The side seals contact the moving belt 10, in the region thereof beyond the electrostatic latent image, and belt 10 slides thereover. Seals 102 are made from a low friction material. By way of example side seals 102 may be made from Delrin AF or any other hard, low friction Isopar compatible material. Chambers 106 act as a pressure barrier to reduce the liquid pressure being applied on side seals 102. Liquid developer material 62 enters onto developer roller 92 from a port coupling chamber 100 (FIG. 5) therewith. The liquid developer material 62 is transported by developer roller 92 into contact with the photoconductive surface of belt 10 to develop the electrostatic latent image recorded thereon.

Figure 7:
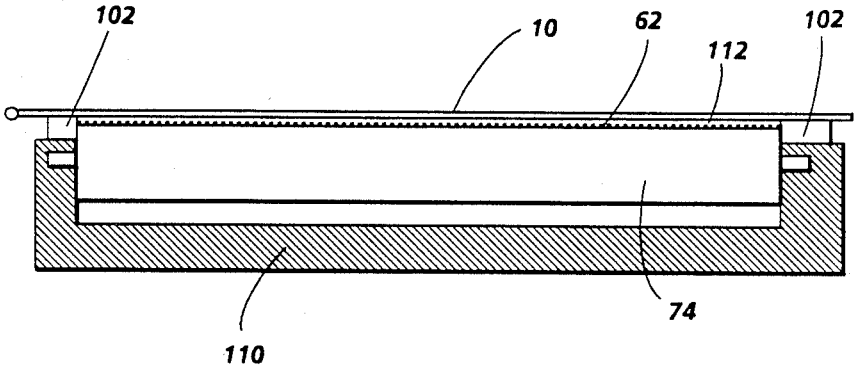
FIG. 7 is a plan view showing a sealing roller used in the FIG. 5 development system.

FIG. 7 is a plan view of one of the sealing rollers used in the FIG. 5 development system. Side seals 108 are secured to housing 110 and contact belt 10 in the region thereof outside that of the electrostatic latent image. Belt 10 slides over side seals 1021. Sealing roller 74 forms a gap 112 between belt 10. The gap 112 formed between the sealing roller 74 and belt 10 prevents the liquid developer material from escaping thereat.

In recapitulation, it is clear that the development system of the present invention forms an extended development zone substantially parallel to the photoconductive belt. The liquid developer material is pumped, at least partially in an upwardly direction, by the moving belt. The pumping action caused by the drag of the belt on the liquid developer material prevents the escape of liquid developer material from the lowermost regionof the development zone. A sealing roller seals the uppermost region of the development zone and meters the quantity of liquid developer material adhering to the photoconductive belt, as the belt exits the development zone. Development is achieved by a flat plate arranged substantially parallel to the moving belt or by a plurality of developer rollers.

It is, therefore, evident that there has been provided in accordance with the present invention, a development system that fully satisfies th aims and advantages heretofore mentioned. While this invention has been described in conjunction with various embodiments, it is evident that many alternatives, modifications and variations will be apparent to those skilled in the art. Accordingly, it is intended to embrace all such alternatives, modifications and variations that fall within the spirit and broad scope of the appended claims.

I claim:

1. An apparatus for developing with a liquid developer material a latent image recorded on a generally planar member moving in a direction at least partially opposed to the direction of the gravitational force exerted thereon, including:

means, defining an extended development zone substantially parallel to the generally planar member, for developing the latent image recorded on the planar member, said developing means cooperating with the generally planar member to pump the liquid developer material in at least a partially upwardly direction from the lowermost region of the development zone to the uppermost region thereof to form a pressure barrier preventing the escape of liquid developer material from the lowermost region of the development zone; and means for sealing the uppermost region of the development zone to prevent the escape of liquid developer material thereat.

2. An apparatus according to claim 1, wherein said sealing means meters the quantity of liquid developer material adhering to the member so as to remove extraneous liquid developer material therefrom.

3. An apparatus according to claim 2, wherein said sealing means includes a sealing roller in the uppermost region of the gap, said sealing roller rotating in a direction so that the tangential velocity of the portion of said sealing roller adjacent the planar member is opposed to the direction of movement of the planar member.

4. An apparatus according to claim 3, wherein said sealing means includes a sealing blade having a free end portion contacting said sealing roller to prevent the escape of developer material thereat.

5. An apparatus according to claim 4, wherein said developing means includes a chamber located in the uppermost region of the development zone for accumulating liquid developer material.

6. An apparatus according to claim 5, said developing means includes an exit port enabling liquid developer material to exit from said chamber.

7. An apparatus according to claim 6, wherein said developing means includes a plate spaced from and substantially parallel with said generally planar member to define a gap therebetween for the liquid developer material.

8. An apparatus according to claim 7, wherein said developing means includes an entrance port for admitting liquid developer material in the lowermost region of the development zone.

9. An apparatus according to claim 8, wherein said developing means includes a second exit port enabling a portion of the liquid developer to drain from the gap in the lowermost region.

10. An apparatus according to claim 9, further including second means for sealing the lowermost region of the development zone to prevent the escape of liquid developer material thereat.

11. An apparatus according to claim 10, wherein said second sealing means includes a sealing roller in the lowermost region of the gap, said sealing roller rotating in a direction so that the tangential velocity of the portion of said sealingroller adjacent thep lanar member is in the same direction as the direction of movement of the planar member.

12. An apparatus according to claim 11, wherein said second sealing means includes a second sealing blade having a free end portion contacting said sealing roller to prevent the escape of developer material thereat.

13. An apparatus according to claim 6, wherein said developing means includes a plurality of spaced developer rollers with each developer roller of said plurality plurality of developer rollers being adjacent the planar member.

14. An apparatus according to claim 13, wherein said developing means includes a plurality of wiper blades with one of said plurality of wiper blades being associated with one of said plurality of developer rollers to remove the extraneous liquid developer material therefrom.

15. An apparatus according to claim 14, wherein said developing means includes a second exit port enabling a portion of the liquid developer to drain from the gap in the lowermost region.

16. An apparatus according to claim 15, wherein said developing means includes an entrance port located intermediate said exit port and said second exit port for admitting liquid developer material to said plurality of developer rollers.

17. An electrophotographic printing machine of the type having an electrostatic latent image recorded on generally planar photoconductive member moving in a direction at least partially opposed to the direction of the gravitation force exerted thereon, including:

means, defining an extended development zone substantially parallel to the generally planar member, for developing the latent image recorded on the planar member with a liquid developer material, said developing means cooperating with the photoconductive member to pump the liquid developer material in at least a partially upwardly direction from the lowermost region of the development zone to the uppermost region thereof to form a pressure barrier preventing the escape of liquid developer material from the lowermost region of the development zone; and means for sealing the uppermost region of the development zone to prevent the escape of liquid developer material thereat.

18. A printing machine according to claim 17, wherein said sealing means meters the quantity of liquid developer material adhering to the member so as to remove extraneous liquid developer material therefrom.

19. A printing machine according to claim 18, wherein said sealing means includes a sealing roller in the uppermost region of the gap, said sealing roller rotating in a direction so that the tangential velocity of the portion of said sealing roller adjacent the planar member is opposed to the direction of movement of the photoconductive member.

20. A printing machine according to claim 19, wherein said sealing means includes a sealing blade having a free end portion contacting said sealing roller to prevent the escape of developer material thereat.

21. A printing machine according to claim 20, wherein said developing means includes a chamber located in the uppermost region of the development zone for accumulating liquid developer material.

22. A printing machine according to claim 21, said developing means includes an exit port enabling liquid developer material to exit from said chamber.

23. A printing machine according to claim 22, wherein said developing means includes a plate spaced from and substantially parallel with the photoconductive member to define a gap therebetween for the liquid developer material.

24. A printing machine according to claim 23, wherein said developing means includes an entrance port for admitting liquid developer material in the lowermost region of the development zone.

25. A printing machine according to claim 24, wherein said developing means includes a second exit port enabling a portion of the liquid developer to drain from the gap in the lowermost region.

26. A printing machine according to claim 25, further including second means for sealing the lowermost region of the development zone to prevent the escape of liquid developer material thereat.

27. A printing machine according to claim 26, wherein said second sealing means includes a sealing roller in the lowermost region of the gap, said sealing roller rotating in a direction so that the tangential velocity of the portion of said sealing roller adjacent the photoconductive member is in the same direction as the direction of movement of the planar member.

28. A printing machine according to claim 27, wherein said second sealing means includes a second sealing blade having a free end portion contacting said sealing roller to prevent the escape of developer material thereat.

29. A printing machine according to claim 22, wherein said developing means includes a plurality of spaced developer rollers with each developer roller of said plurality plurality of developer rollers being adjacent the planar member.

30. A printing machine according to claim 29, wherein said developing means includes a plurality of wiper blades with one of said plurality of wiper blades being associated with one of said plurality of developer rollers to remove the extraneous liquid developer material therefrom.

31. A printing machine according to claim 30, wherein said developing means includes a second exit port enabling a portion of the liquid developer to drain from the gap in the lowermost region.

32. A printing machine according to claim 31 wherein said developing means includes an entrance port located intermediate said exit port and said second exit port for admitting liquid developer material to said plurality of developer rollers.

33. A printing machine according to claim 32 the photoconductive member is a flexible belt.

* * * * *